US005997309A

United States Patent [19]

Metheny et al.

[11] Patent Number: 5,997,309

[45] Date of Patent: Dec. 7, 1999

[54] ERASABLE DRAWING BOARD

[76] Inventors: Jeff Metheny, 494 Valley View Rd., Eighty Four, Pa. 15330; Greg A. Hopkins, Box 46, Nineveh, Pa. 15353

[21] Appl. No.: 09/224,306

[22] Filed: Dec. 31, 1998

[51] Int. Cl.[6] ..... B43L 1/00

[52] U.S. Cl. ..... 434/409; 434/408

[58] Field of Search ..... 434/247, 248, 434/416, 408, 409, 410, 411, 412, 413

[56] References Cited

U.S. PATENT DOCUMENTS

| | | | |
|---|---|---|---|
| 4,590,381 | 5/1986 | Mendelson | 434/408 |
| 5,099,594 | 3/1992 | Reas et al. | 40/593 |
| 5,263,866 | 11/1993 | Campbell | 434/248 |
| 5,820,385 | 10/1998 | Ohashi et al. | 434/408 |

FOREIGN PATENT DOCUMENTS

| | | | |
|---|---|---|---|
| 2034640A | 6/1980 | United Kingdom | 434/409 |
| 2214137A | 8/1989 | United Kingdom | 434/409 |

OTHER PUBLICATIONS

The Tate Slate. Thalatta, Inc. pp. 1–2, Feb. 21, 1985.

*Primary Examiner*—Kien T. Nguyen
*Assistant Examiner*—Bena B. Miller

[57] ABSTRACT

A play strategy erasable screen assembly is provided including a housing and a display mechanism mounted thereon. The display mechanism includes an upper transparent layer, a thin compartment situated thereunder within an interior space of the housing, and a predetermined amount of metallic shavings situated within the compartment. A plurality of stamps are included each having magnets mounted thereon for being placed on the transparent layer of the display mechanism to adhere the metallic shavings on the transparent layer in a configuration similar to that in which the magnets are mounted on the stamps. Next provided is an erasure assembly for selectively removing the metallic shavings from the transparent layer.

6 Claims, 2 Drawing Sheets

ERASABLE DRAWING BOARD

BACKGROUND OF THE INVENTION

1. Field of the Invention

The present invention relates to magnetic displays and more particularly pertains to a new erasable drawing board for displaying plays on a portable unit for use by a coach.

2. Description of the Prior Art

The use of magnetic displays is known in the prior art. More specifically, magnetic displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art magnetic displays and the like include U.S. Pat. No. 5,626,478; U.S. Pat. No. 5,263,866; U.S. Pat. No. 4,931,019; U.S. Pat. No. 3,562,927; U.S. Pat. Des. No. 380,398; and U.S. Pat. No. 2,643,466 which are each incorporated herein by reference.

In these respects, the erasable drawing board according to the present invention substantially departs from the conventional concepts and designs of the prior art, and in so doing provides an apparatus primarily developed for the purpose of displaying plays on a portable unit for use by a coach.

SUMMARY OF THE INVENTION

In view of the foregoing disadvantages inherent in the known types of magnetic displays now present in the prior art, the present invention provides a new erasable drawing board construction wherein the same can be utilized for displaying plays on a portable unit for use by a coach.

The general purpose of the present invention, which will be described subsequently in greater detail, is to provide a new erasable drawing board apparatus and method which has many of the advantages of the magnetic displays mentioned heretofore and many novel features that result in a new erasable drawing board which is not anticipated, rendered obvious, suggested, or even implied by any of the prior art magnetic displays, either alone or in any combination thereof.

To attain this, the present invention generally comprises a housing having a rectangular configuration. As shown in FIG. 1, the housing includes a front face, a rear face and a periphery formed therebetween formed of an elongated top edge, an elongated bottom edge and a pair of short side edges. The top face has a plurality of recesses formed therein adjacent to a first one of the side edges. The recesses further include an upper rectangular recess, a lower square recess and an elongated oval recess with a pair of dips flanking the same. The housing also includes an oval cut out formed between the front face and the rear face. Such cut out is further situated between the oval recess and the first side edge in parallel relationship therewith for defining a handle. Next provided is a display mechanism mounted on the front face between the top edge and the bottom edge. As shown in FIG. 1, the display mechanism is positioned between the recesses and a second one of the side edges. It should be noted that the display mechanism includes an upper transparent layer and a thin compartment situated thereunder within the interior space of the housing. A predetermined amount of iron shavings are situated within the compartment for reasons that will soon become apparent. Also included is a writing utensil being removably positioned within the oval recess of the housing. As shown in FIG. 2, the writing utensil has a cylindrical configuration and a first and second end. The first end includes a conical tip with a magnetic piece mounted thereon for sliding on the transparent layer of the display mechanism. This effects the adhering of the iron shavings to an inner surface of the transparent layer of the display mechanism in a user-defined desired manner. The second end of the writing utensil includes a sleeve of a reduced diameter extending therefrom in coaxial relationship with the writing utensil. Such sleeve serves for receiving a dry erase or grease marker tip to also illustrate marks on an outer surface of the transparent layer of the display mechanism. As shown in FIG. 2, the sleeve has a peripheral detent formed on an inboard end thereof for snappily receiving a cap thereon for protection purposes FIG. 3 depicts a hand-held eraser being removably positioned within the square recess of the housing. Such eraser includes a planar square rigid handle with a rectilinear sponge mounted to an underside thereof. In use, the eraser is adapted for removing marks made on an outer surface of the transparent layer by the aforementioned dry erase markers. As an option, erasers may be equipped to remove the iron shavings from the transparent layer by way of a repelling magnet or some other mechanism. FIGS. 4–7 depict a plurality of stamps for being removably positioned within the rectangular recesses of the housing. Each stamp includes a planar rectangular rigid Plexiglas or wire mesh screen which is transparent. A top face of each stamp is equipped with an inverted frustoconical handle mounted on a central extent thereof. A bottom face of each stamp has a plurality of magnetic alphabetic letters mounted thereon. Such alphabetic letters each represent players on a team. Further, the letters of each stamp are configured to resemble a distinct mode of play including, but not limited to defense mode, offense mode, kicking mode and the like. In use, the magnetic letters of the stamp may be removably placed on the transparent layer of the display mechanism for adhering the iron shavings thereto. When the stamps are placed on the display mechanism, the iron shavings render the corresponding configuration of alphabetic letters on the display mechanism. Finally, an erasure assembly is provided including a disk-shaped handle slidably mounted within a slot formed between the display mechanism and the recesses. The disk-shaped handle is connected to an end of a magnetic bar which extends laterally between side edges of the display mechanism and slidably abuts the inner surface of the transparent layer of the display mechanism. By this structure, the iron shavings are removed from the inner surface of the transparent layer upon the handle being maneuvered along the slot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new erasable drawing board apparatus and method which has many of the advantages of the magnetic displays mentioned heretofore and many novel features that result in a new erasable drawing board which is not anticipated, rendered obvious, suggested, or even implied by any of the prior art magnetic displays, either alone or in any combination thereof.

It is another object of the present invention to provide a new erasable drawing board which may be easily and efficiently manufactured and marketed.

It is a further object of the present invention to provide a new erasable drawing board which is of a durable and reliable construction.

An even further object of the present invention is to provide a new erasable drawing board which is susceptible of a low cost of manufacture with regard to both materials and labor, and which accordingly is then susceptible of low prices of sale to the consuming public, thereby making such erasable drawing board economically available to the buying public.

Still yet another object of the present invention is to provide a new erasable drawing board which provides in the apparatuses and methods of the prior art some of the advantages thereof, while simultaneously overcoming some of the disadvantages normally associated therewith.

Still another object of the present invention is to provide a new erasable drawing board for displaying plays on a portable unit for use by a coach.

Even still another object of the present invention is to provide a new erasable drawing board that includes a housing and a display mechanism mounted thereon. The display mechanism includes an upper transparent layer, a thin compartment situated thereunder within an interior space of the housing, and a predetermined amount of metallic shavings situated within the compartment. A plurality of stamps are included each having magnets mounted thereon for being placed on the transparent layer of the display mechanism to adhere the metallic shavings on the transparent layer in a configuration similar to that in which the magnets are mounted on the stamps. Optionally provided is an erasure assembly for selectively removing the metallic shavings from the transparent layer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
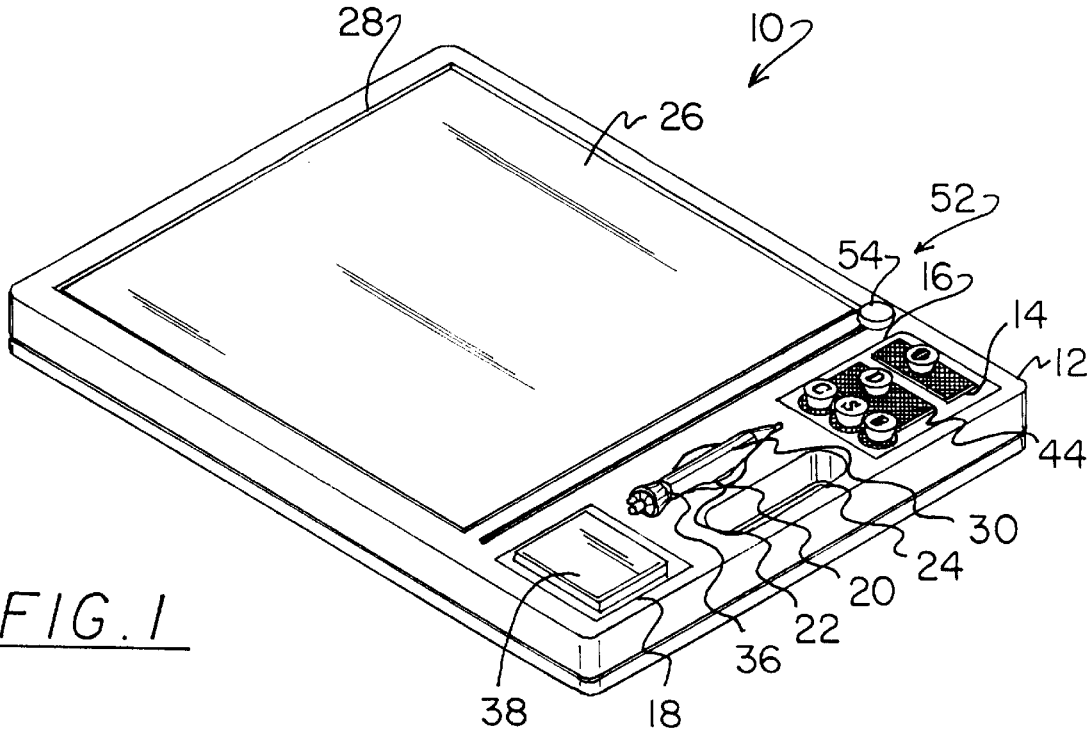
FIG. 1 is a perspective view of a new erasable drawing board according to the present invention.

With reference now to the drawings, and in particular to FIGS. 1 through 8 thereof, a new erasable drawing board embodying the principles and concepts of the present invention and generally designated by the reference numeral 10 will be described.

The present invention, designated as numeral 10, includes a housing 12 having a rectangular configuration. As shown in FIG. 1, the housing includes a front face, a rear face and a periphery formed therebetween formed of an elongated top edge, an elongated bottom edge and a pair of short side edges.

The top face of the housing has a plurality of recesses 14 formed therein adjacent to a first one of the side edges. The recesses include an upper rectangular recess 16, a lower square recess 18 and an elongated oval recess 20 with a pair of dips 22 flanking the same. The housing also includes an oval cut out 24 formed between the front face and the rear face. Such cut out is further situated between the oval recess and the first side edge in parallel relationship therewith for defining a handle.

Next provided is a display mechanism 26 mounted on the front face of the housing between the top edge and the bottom edge. As shown in FIG. 1, the display mechanism is positioned between the recesses and a second one of the side edges. It should be noted that the display mechanism includes a polymeric upper transparent layer 28 and a thin compartment situated thereunder within the interior space of the housing. A predetermined amount of iron shavings are situated within the compartment for reasons that will soon become apparent.

Figure 2:
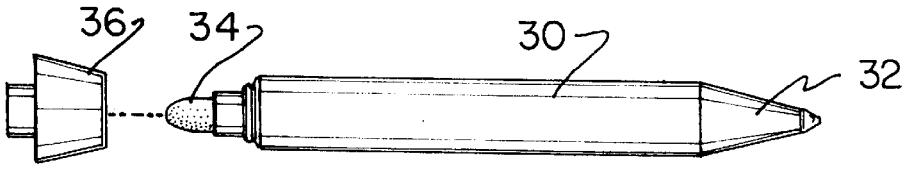
FIG. 2 is a side view of the writing utensil of the present invention.

Also included is a writing utensil 30 being removably positioned within the oval recess of the housing. As shown in FIG. 2, the writing utensil has a cylindrical configuration and a first and second end. The first end includes a conical tip 32 with a magnetic piece mounted thereon for sliding on the transparent layer of the display mechanism. This effects the adhering of the iron shavings to an inner surface of the transparent layer of the display mechanism in a user-defined, desired manner. Such adhering may be accomplished by either an electrostatic charge or an actual adhesive situated on the inner surface of the transparent layer of the display mechanism.

The second end of the writing utensil includes a sleeve of a reduced diameter extending therefrom in coaxial relationship with the writing utensil. Such sleeve serves for receiving a dry erase marker tip 34 to form marks on an outer surface of the transparent layer of the display mechanism. As shown in FIG. 2, the sleeve has a peripheral detent formed on an inboard end thereof for snappily receiving a cap 36 thereon for protection purposes.

Figure 3:
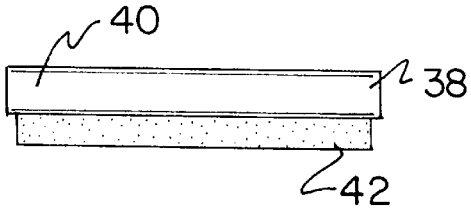
FIG. 3 is a side view of the hand-held eraser of the present invention.
Figure 4:
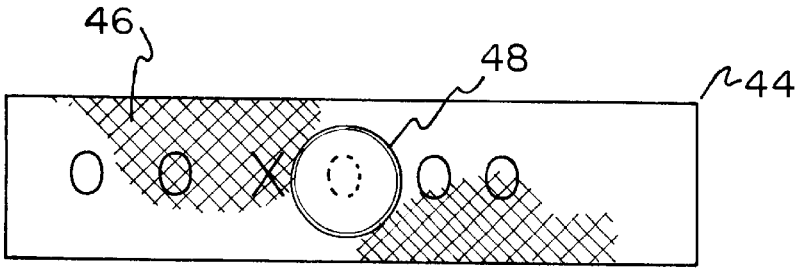
FIG. 4 is a top view of one of the stamps of the present invention representing an offensive configuration.
Figure 5:
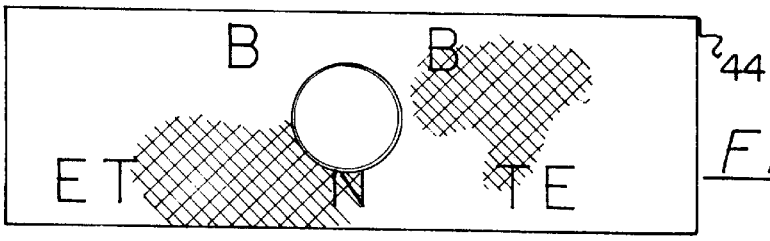
FIG. 5 is a top view of one of the stamps of the present invention representing a standard 50 defensive configuration.
Figure 6:
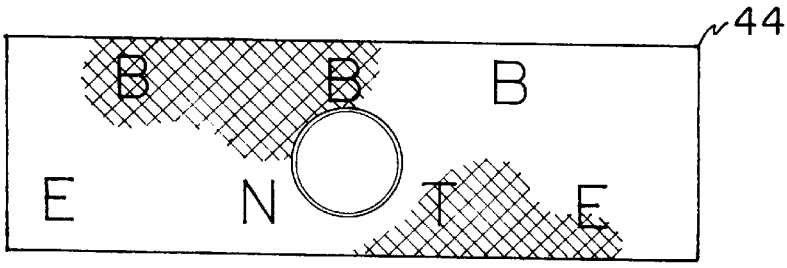
FIG. 6 is a top view of one of the stamps of the present invention representing a standard 40 defensive configuration.
Figure 7:
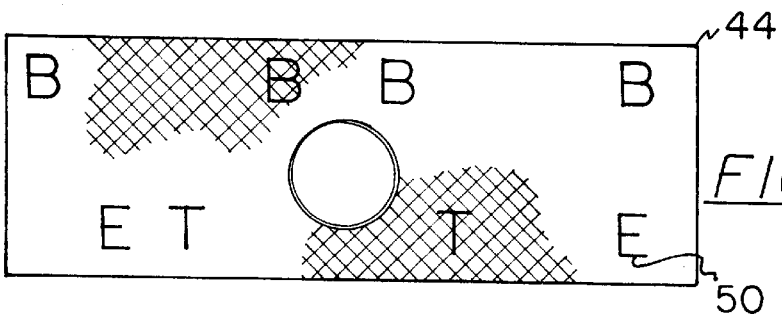
FIG. 7 is a top view of one of the stamps of the present invention representing a universal defensive configuration.
Figure 8:
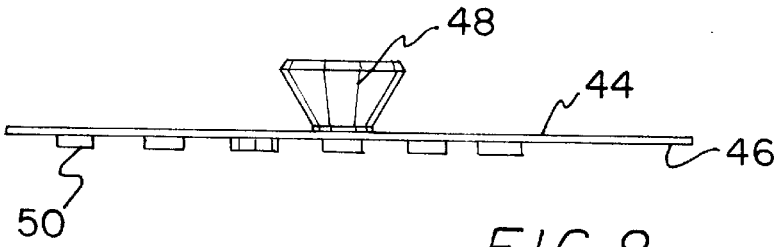
FIG. 8 is a side view of one of the stamps of the present invention.

FIG. 3 depicts a hand-held eraser 38 being removably positioned within the square recess of the housing. Such eraser includes a planar square rigid handle 40 with a rectilinear sponge 42 mounted to an underside thereof. In use, the eraser is adapted for removing marks made on an outer surface of the transparent layer by the aforementioned dry erase markers. As an option, the erasers of the present invention may be equipped to remove the iron shavings from the transparent layer by way of a repelling magnet or some other mechanism.

FIGS. 4–7 depict a plurality of stamps 44 for being removably positioned within the rectangular recesses of the housing with a handle thereof protruding upwardly for allowing convenient removal. Each stamp includes a planar rectangular rigid wire mesh screen 46 which is transparent. A top face of each stamp is equipped with an inverted frusto-conical handle 48 mounted on a central extent thereof.

A bottom face of each stamp has a plurality of magnetic alphabetic letters 50 mounted thereon. Such alphabetic letters each represent players on a team. Further, the letters of each stamp are configured to resemble a distinct mode of play including, but not limited to a defense mode, an offense mode, a kicking mode and the like. Its should be understood that the specific orientation of the alphabetic letters is dependent on a sport with which the present invention is to be used. In use, the magnetic letters of the stamp may be removably placed on the transparent layer of the display mechanism for adhering the iron shavings thereto. When the stamps are placed on the display mechanism, the iron shavings render the corresponding configuration of alphabetic letters on the display mechanism. As an option, a plurality of individual stamps may be included without the wire mesh screen and the associated letters may be mounted directly on the handle. Note FIG. 1. Such stamps may be selectively used to represent individual players on the display mechanism.

Finally, an erasure assembly 52 is provided including a disk-shaped handle 54 slidably mounted within a slot formed between the display mechanism and the recesses. The disk-shaped handle is connected to an end of a magnet bar (not shown) which extends laterally between side edges of the display mechanism and slidably abuts the inner surface of the transparent layer of the display mechanism. By this structure, the iron shavings are removed from the inner surface of the transparent layer upon the handle being maneuvered along the slot. The amount of shavings and the strength of the magnetic bar are preferably selected to ensure that not all of the shavings adhere to the bar. It should be understood that any other type of magnetic display system may be used in combination with the present invention which may be written on and erased in a varied manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A play strategy erasable screen assembly comprising, in combination:

a housing having a rectangular configuration including a front face, a rear face and a periphery formed therebetween formed of an elongated top edge, an elongated bottom edge and a pair of short side edges for defining an interior space, the top face having a plurality of recesses formed therein adjacent to a first one of the side edges, the recesses including an upper rectangular recess, a lower square recess and an elongated oval recess with a pair of dips flanking the same, the housing further including an oval cut out formed between the front face and the rear face and further situated between the oval recess and the first one of the side edges in parallel relationship therewith for defining a handle;

a display mechanism mounted on the front face between the top edge and the bottom edge and further between the recesses and a second one of the side edges, the display including an upper transparent layer, a thin compartment situated thereunder within the interior space of the housing, and a predetermined amount of iron shavings situated within the compartment;

a writing utensil being removably positioned within the oval recess of the housing, the writing utensil having a cylindrical configuration and a first end including a conical tip with a magnetic piece mounted thereon for sliding on the transparent layer of the display mechanism for electrostatically adhering the iron shavings to an inner surface thereof in a desired manner, the writing utensil further including a second end with a sleeve of a reduced diameter extending therefrom in coaxial relationship with the writing utensil with a dry erase marker tip mounted thereon, the sleeve having a peripheral detent formed on an inboard end thereof for snappily receiving a cap thereon;

a hand-held eraser being removably positioned within the square recess of the housing;

a plurality of stamps being removably positioned within the rectangular recesses of the housing, each stamp including a planar rectangular rigid wire mesh screen with a top face having an inverted frusto-conical handle mounted on a central extent thereof and a bottom face with a plurality of magnetic alphabetic letters mounted thereon, the alphabetic letters each representing players on a team and the letters of each stamp configured to resemble a distinct mode of play, wherein the magnetic letters of the stamp may be removably placed on the transparent layer of the display mechanism for adhering the iron shavings thereto to render the corresponding configuration of alphabetic letters on the display mechanism; and an erasure assembly including a disk-shaped handle slidably mounted within a slot formed between the display mechanism and the recesses, the disk-shaped handle connected to an end of a magnetic bar which extends laterally between side edges of the display mechanism and slidably abuts the inner surface of the transparent layer of the display mechanism, wherein the iron shavings are removed from the inner surface of the transparent layer upon the handle being maneuvered along the slot.

2. A play strategy erasable screen assembly comprising:

a housing;

a display mechanism mounted on the housing and including an upper transparent layer, a thin compartment situated thereunder within an interior space of the housing, and a predetermined amount of metallic shavings situated within the compartment;

a plurality of stamps each having a transparent wire mesh on which magnets are mounted, the magnets being for placing on the transparent layer of the display mechanism to electrostatically adhere the metallic shavings on the transparent layer in a configuration similar to that in which the magnets are mounted on the stamps; and an erasure assembly for selectively removing the metallic shavings from the transparent layer.

3. A play strategy erasable screen assembly as set forth in claim 2 wherein the magnets are configured on each of the stamps to represent a mode of play.

4. A play strategy erasable screen assembly as set forth in claim 2 wherein a writing utensil is included with a magnetic piece mounted thereon for selectively adhering the metallic shavings to the transparent layer in a user-defined manner.

5. A play strategy erasable screen assembly as set forth in claim 2 wherein a recess is formed in the housing for containing the stamps.

6. A play strategy erasable screen assembly as set forth in claim 2 wherein the erasure assembly includes a handle slidably mounted within a slot formed along the display mechanism, the handle connected to an end of a magnetic bar which slidably abuts an inner surface of the transparent layer of the display mechanism, wherein the metallic shavings are removed from the inner surface of the transparent layer upon the handle being maneuvered along the slot.

* * * * *